US007131901B2

(12) United States Patent
Shih et al.

(10) Patent No.: US 7,131,901 B2
(45) Date of Patent: Nov. 7, 2006

(54) POLISHING PAD AND FABRICATING METHOD THEREOF

(75) Inventors: Wen-Chang Shih, Taichung (TW); Yung-Chung Chang, Taipei (TW); Min-Kuei Chu, Taichung (TW)

(73) Assignee: IV Technologies Co., Ltd., Taichung (TW)

( * ) Notice: Subject to any disclaimer, the term of this patent is extended or adjusted under 35 U.S.C. 154(b) by 0 days.

(21) Appl. No.: 10/711,622

(22) Filed: Sep. 29, 2004

(65) Prior Publication Data

US 2005/0070217 A1 Mar. 31, 2005

(51) Int. Cl.
*B24D 11/00* (2006.01)

(52) U.S. Cl. ..... 451/527; 451/530; 51/293

(58) Field of Classification Search ..... 451/526, 451/527, 530, 529, 41, 285, 287; 51/293; 6/307

See application file for complete search history.

(56) References Cited

U.S. PATENT DOCUMENTS 6,517,419 B1 * 2/2003 Halley ..... 451/56
6,749,485 B1 * 6/2004 James et al. ..... 451/41
6,783,436 B1 * 8/2004 Muldowney ..... 451/41
6,783,448 B1 * 8/2004 Sabo ..... 451/359
6,824,455 B1 * 11/2004 Osterheld et al. ..... 451/285
2002/0077053 A1 * 6/2002 Pham ..... 451/526

* cited by examiner

*Primary Examiner*—Jacob K. Ackun, Jr.
(74) *Attorney, Agent, or Firm*—Jiang Chyun IP Office

(57) ABSTRACT

A polishing pad having a polishing surface, a back surface and a sidewall is provided. The sidewall is connected to the polishing surface and the back surface. The polishing pad includes a polishing region and a region neighboring to the polishing region. Wherein, at least one stress buffer pattern is designed in the neighboring region. The stress buffer pattern is formed to buffer the stress created during a polishing process to prevent the region from being protruded and thus prevent the surface of the region, once protruded, from rubbing against the wafer carrier to generate particles, so that contamination of the surface of the wafers can be avoided. On the other hand, at least one cambered surface can be designed on the sidewall of the polishing pad to prevent the sidewall from rubbing against the wafer carrier to generate particles, so that contamination can be avoided.

20 Claims, 7 Drawing Sheets

POLISHING PAD AND FABRICATING METHOD THEREOF

CROSS-REFERENCE TO RELATED APPLICATION

This application claims the priority benefit of Taiwan applications serial no. 92126795, filed Sep. 29, 2003 and serial no. 93102897, filed Feb. 9, 2004.

BACKGROUND OF THE INVENTION

1. Field of the Invention

The present invention relates to a polishing pad and fabricating method thereof, and more particularly to a polishing pad and fabricating method of the same suitable to prevent particles from being generated during a polishing process.

2. Description of the Related Art

Nowadays, chemical mechanical polishing (CMP) processes are commonly used to achieve global planarization. In a conventional CMP process, polishing slurry containing abrasive particles is applied on the surface of a wafer and set in relative motion with respect to a polishing pad with appropriate elasticity and hardness for the purpose of planarization of the wafer.

FIG. 1 shows a top view and a side view of a wafer carrier holding a wafer on a polishing pad in a conventional polishing process. As shown in FIG. 1, a wafer 100 is held by a wafer carrier 102, for example, in a way that a retaining ring 104 is used to attach the wafer 100 on the bottom surface of the wafer carrier 102. The wafer carrier 102 holds the wafer 100 to spin on the polishing pad 110, and the polishing pad 110 itself also rotates driven by a polishing table, while a polishing slurry is provided between the surface of the wafer 100 and the polishing pad 110 for the polishing process. Abrasive particles in the slurry contact with and rub against the surface of the wafer 100, which causes abrasion on the surface of the wafer 100 and thus make the surface becoming planar. The relative motion between the polishing pad 110 and the surface of the wafer 100 includes not only rotational motion of the wafer 100 and the polishing pad 110 but also horizontal swing motion of the wafer 100.

Referring further to FIG. 1, when the wafer carrier 102 brings the wafer 100 slightly in a horizontal swing motion within the polishing region 112 of the polishing pad 110, the motion will induce a compressive stress on the polishing pad 110 towards the center of the polishing pad 110 so as to compress the central region 114 to become protruded. When the wafer 100 continues to be polished on the protruded polishing pad 110, the retaining ring 104 on the wafer carrier 102 may rub against the protruded surface of the central region 114 of the polishing pad 110 and thus generate particles. Since a trench 106 is ordinarily designed in the retaining ring 104 on the wafer carrier, the particles generated due to the rubbing may pass through the trench 106 in the retaining ring 104, reach the wafer 100, and further contaminate the wafer 100.

In addition, since the polishing surface of the polishing pad 110 is perpendicular with the sidewall 116 of the polishing pad 110, when the wafer carrier 102 brings the wafer 100 slightly in a horizontal swing motion within the polishing region 112, the retaining ring 104 on the wafer-holding device 102 may rub against the sidewall 116 of the polishing pad 110 to generate small particles, and the particles may pass through the trench 106 in the retaining ring 104, reach the wafer 100, and further contaminate the wafer 100.

During a conventional polishing process, as described above, the surface of the central region or the edge portions of the polishing pad may rub against the retaining ring of the wafer carrier, which will generates small particles to contaminate the wafer.

SUMMARY OF THE INVENTION

Accordingly, the present invention is directed to a polishing pad and a fabricating method thereof, so as to prevent particles from being generated in the central region of the polishing surface under compressing stress during a polishing process.

The present invention is directed to a polishing pad and a fabricating method thereof, so as to prevent particles from being generated on the sidewall of the polishing pad during a polishing process.

According to an embodiment of the present invention, a polishing pad is provided as having a polishing surface, a back surface, and a sidewall connected with the polishing surface and the back surface, and being divided into a polishing region and a region neighboring to the polishing region. Wherein, at least one stress buffer pattern is designed within the region of the polishing pad to buffer compressing stress generated in the region during the polishing process and to prevent the surface of the region from being protruded.

According to another embodiment of the present invention, a fabricating method of a polishing pad having a polishing surface, a back surface, and a sidewall connected with the polishing surface and the back surface is provided. The method includes formation of a polishing region and at least one stress buffer pattern within a region of the polishing pad neighboring to the polishing region so as to buffer compressing stress generated in the region during the polishing process and to prevent the surface of the region from being protruded.

The present invention further provides another polishing pad, which has a polishing surface, a back surface, and a sidewall connected with polishing surface and the back surface. Wherein, at least one cambered surface is formed on the sidewall at the join of the sidewall and the polishing surface so as to prevent the sidewall from being rubbed to generate small particles.

The present invention further provides another fabricating method of a polishing pad having a polishing surface, a back surface, and a sidewall connected with the polishing surface and the back surface. The method includes formation of at least one cambered surface on the sidewall of the polishing pad so as to prevent the sidewall from being rubbed to generate small particles.

According to the preferred embodiments of this invention, the above-mentioned stress buffer patterns can be formed, for example, in the polishing surface, the back surface, or both. The stress buffer pattern can be formed in the central region or the edge region of the polishing pad, for example, via a mechanical process, a chemical process, or a molding process. In addition, the stress buffer pattern can be a plurality of trenches or at least one opening. Moreover, the depth of the trenches or the opening is, for example, less than half of the thickness of the polishing pad.

According to the preferred embodiments of this invention, the above-mentioned cambered surface is formed on the sidewall of the polishing pad, for example, via a mechanical process, a chemical process, or a molding process.

According to the preferred embodiments of this invention, at least one cambered surface can be formed on the sidewall formed on a side surface of the trenches (or the openings) near the polishing surface. Similarly, the cambered surface is formed, for example, via a mechanical process, a chemical process, or a molding process.

It is to be understood that both the foregoing general description and the following detailed description are exemplary, and are intended to provide further explanation of the invention as claimed.

DESCRIPTION OF THE PREFERRED EMBODIMENTS

Figure 1:
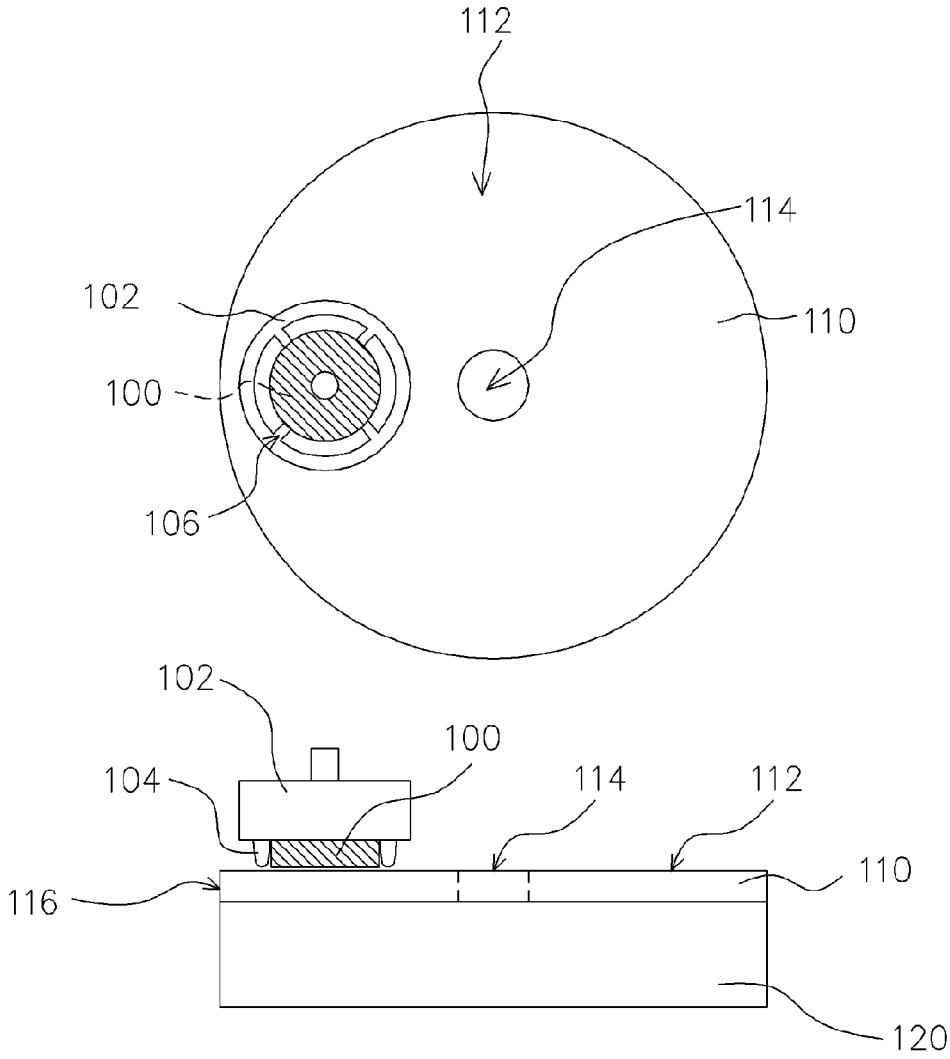
FIG. 1 is a top view showing a conventional polishing pad.

Reference will now be made in detail to the preferred embodiments of the invention, examples of which are illustrated in the accompanying drawings. Wherever possible, the same reference numbers are used in the drawings and the description to refer the same or like parts.

Figure 2:
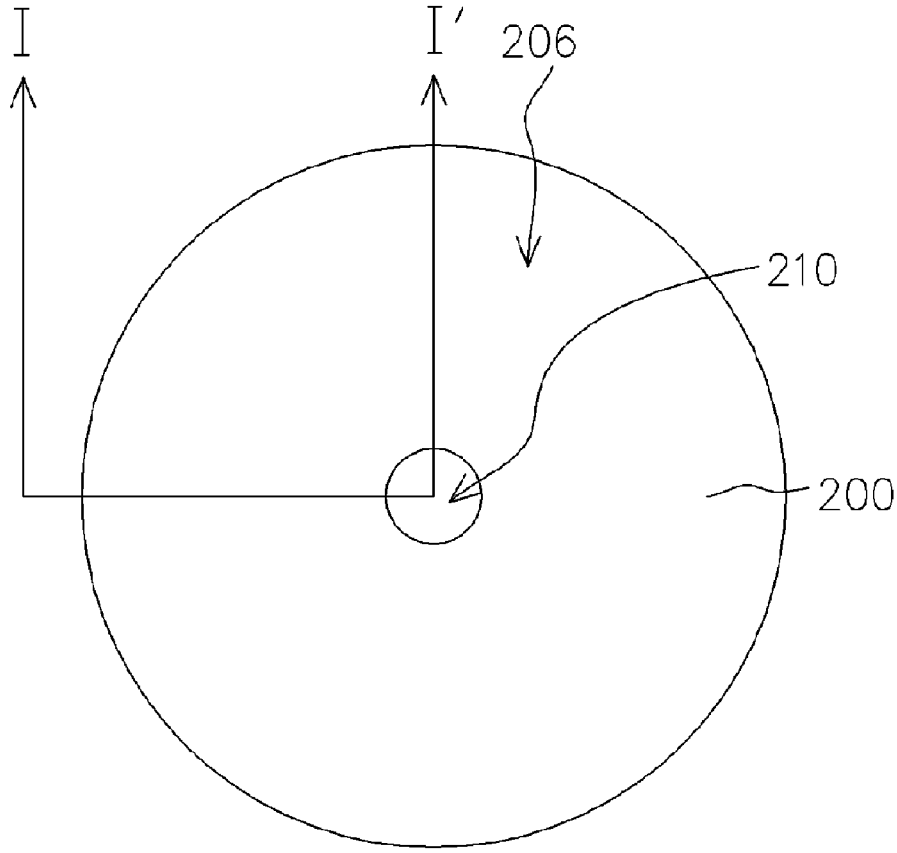
FIG. 2 is a top view showing a polishing pad according to one preferred embodiment of the present invention.
Figure 3A:
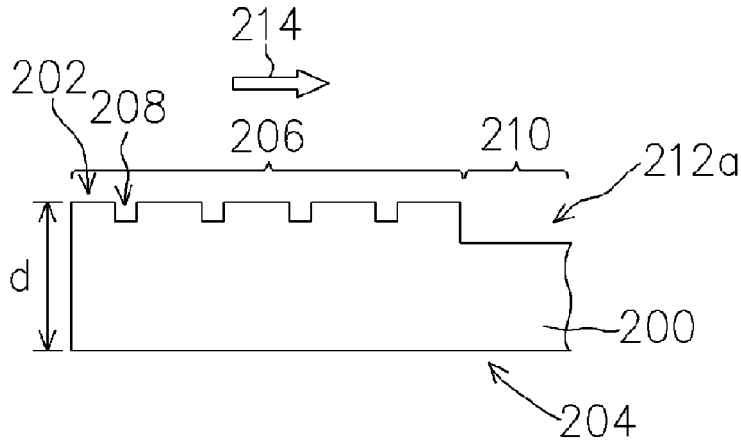
FIGS. 3A to 3K are sectional views showing a polishing pad according to preferred embodiments of the present invention.

FIG. 2 is a top view showing a polishing pad according to one preferred embodiment of the present invention, while FIG. 3A is a cross-sectional view along the line I–I' in FIG. 2A according to one preferred embodiment of the present invention. Referring to FIG. 2 and FIG. 3A, the polishing pad 200 has a top surface 202 and a back surface 204, and the polishing pad 200 is divided into the polishing region 206 and the central region 210 neighboring to the polishing region 206. The top surface 202 is also called a polishing surface in the embodiments. In this preferred embodiment, the polishing pad 200 is made of, for example, polymer, such as polyurethane, epoxy resin, melamine, or other thermosetting resin.

In the polishing region 206 of the polishing pad 200, there is a plurality of first trenches 208 to make polishing slurry evenly distributed on the polishing pad 200 during the polishing process. In addition, the central region 210 of the polishing pad 200 is, for instance, a circular region that is concentric with the surface of the polishing pad 200 and has a radius of 40 mm. In the present invention, the stress buffer pattern 212*a* is designed within the central region 210 of the polishing pad 200 to buffer compressing stress generated towards the central region 210 due to swing motion of the wafer during the polishing process, so that the surface of the central region 210 is prevented from being protruded under the compressing stress. Wherein, the compressing stress is asserted in the direction, for example, as shown by the arrow 214.

In this preferred embodiment, the stress buffer pattern 212*a* may be, for example, an opening. The depth of the opening is, for example, greater than the depth of the first trenches 208 but less than half of the thickness d of the polishing pad 200. The stress buffer pattern 212*a* can be formed via a mechanical process, such as by using a cutter to cut the stress buffer pattern 212*a*, or via a chemical process, such as etching to form the stress buffer pattern 212*a* in the central region 210. Of course, the stress buffer pattern 212*a* can be also formed via a molding process.

Figure 3B:
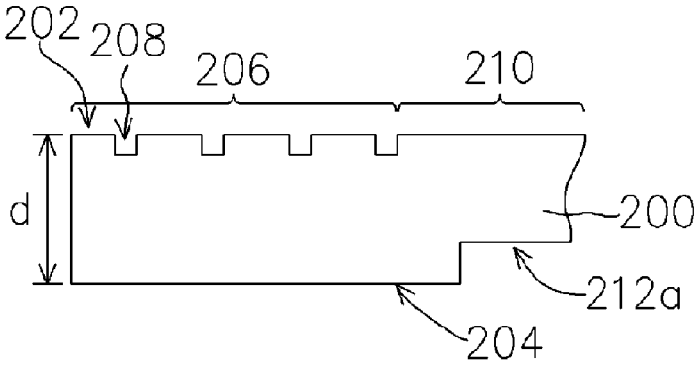

In another preferred embodiment of the present invention, referring to FIG. 2 and FIG. 3B, the stress buffer pattern 212*a* can also be formed in the central region 210 of the back surface 204 of the polishing pad 200. The depth of the stress buffer pattern 212*a* is, for example, greater than the depth of the first trenches 208 but less than half of the thickness d of the polishing pad 200. The methods to form the stress buffer pattern 212*a* are the same as that described above, and thus no details are further given here for simplicity.

Figure 3C:
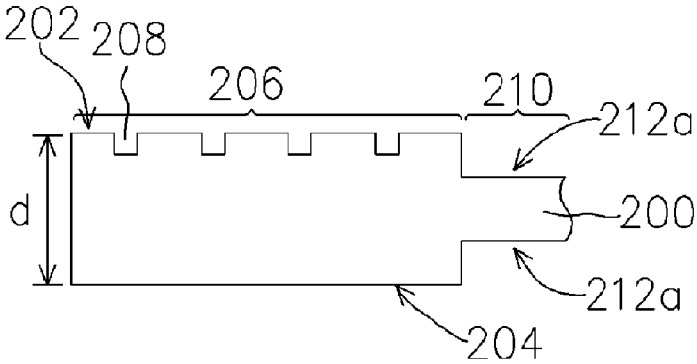

In yet another preferred embodiment of the present invention, referring to FIG. 2 and FIG. 3C, the stress buffer pattern 212*a* can be formed simultaneously on both the polishing surface 202 and the back surface 204 of the polishing pad 200. The depth of the stress buffer patterns 212*a* on the polishing surface 202 and on the back surface 204 is, for example, respectively greater than the depth of the first trenches 208, but additively less than half of the thickness d of the polishing pad 200.

In this embodiment, the stress buffer pattern on the polishing pad is illustrated as a single pattern of opening, which is set forth for the purpose of explanation but by no means to limit the shape of the stress buffer pattern. The stress buffer pattern on the polishing pad in this invention can be a pattern of other shapes formed in the central region of the polishing pad permissibly through any process. The stress buffer pattern can be, for example, a pattern of opening consisting of at least a circular opening or a polygonal opening.

In the above embodiment, the stress buffer pattern of the polishing pad is a pattern of opening. In yet another embodiment of this invention, however, the stress buffer pattern can also be a pattern consisting of a plurality of trenches.

Figure 3D:
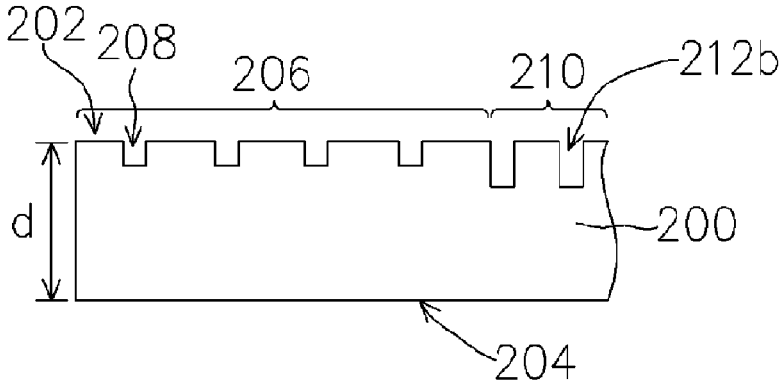

Referring to FIG. 2 and FIG. 3D, the stress buffer pattern 212*b* may be, for example, a plurality of second trenches. The depth of the second trenches is, for example, greater than the depth of the first trenches 208 but less than half of the thickness d of the polishing pad 200. The stress buffer pattern 212*b* is designed within the central region 210 of the polishing pad 200 to buffer compressing stress generated towards the central region 210 due to swing motion of the wafer during the polishing process, so that the surface of the central region 210 is prevented from being protruded under the compressing stress. The methods to form the stress buffer pattern 212*b* are the same as that to form the stress buffer pattern 212*a*.

Figure 3E:
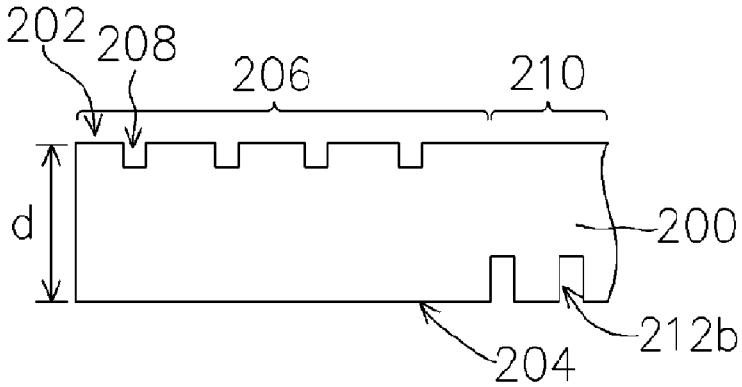

In yet another preferred embodiment of the present invention, referring to FIG. 2 and FIG. 3E, the stress buffer pattern 212*b* can also be formed in the central region 210 of the back surface 204 of the polishing pad 200. The depth of the stress buffer pattern 212*b* is, for example, greater than the depth of the first trenches 208 but less than half of the thickness d of the polishing pad 200.

Figure 3F:
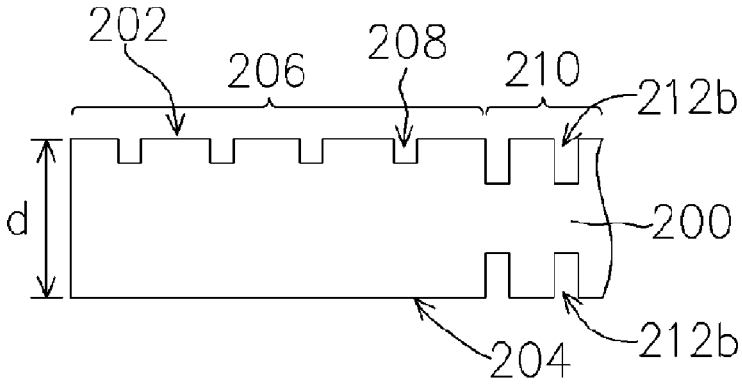

In yet another preferred embodiment of the present invention, referring to FIG. 2 and FIG. 3F, the stress buffer pattern 212*b* can be formed simultaneously on both the polishing surface 202 and the back surface 204 of the polishing pad 200. The depth of the stress buffer patterns 212*b* on the polishing surface 202 and on the back surface 204 is, for example, respectively greater than the depth of the first trenches 208, but additively less than half of the thickness d of the polishing pad 200.

Figure 3G:
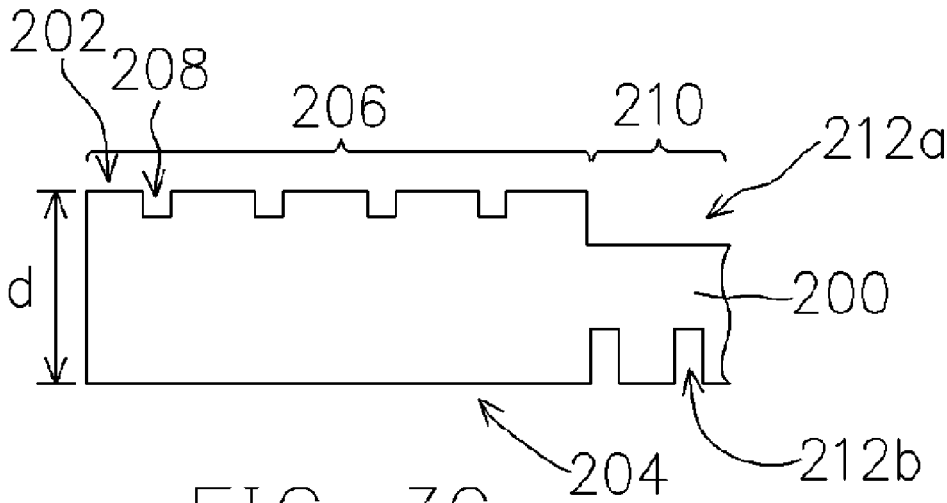
Figure 3H:
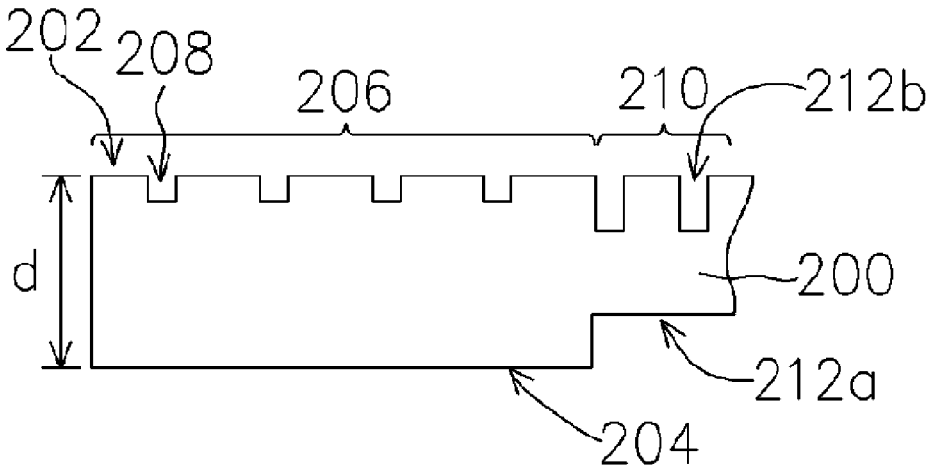

In addition, referring to FIG. 3G and FIG. 3H, a pattern of opening 202*a* and a pattern of trenches 202*b* can be designed in the central region 210 of the polishing surface 202 and the back surface 204, respectively. The total depth of the pattern 212*a* plus the pattern 212*b* is, for example, less than half of the thickness of the polishing pad 200.

In the above embodiment, the trenches of the stress buffer pattern can be in a distribution of concentric circle, spiral, whirlpool, grid, radial strips, or perforation. There is no limitation on such distribution in this invention.

In all of the embodiments of this invention, the depth of the stress buffer pattern on the polishing pad is, for example, greater than the depth of the trenches in the polishing region, and the additive depth of the stress buffer patterns on the polishing surface and on the back surface is less than half of the thickness of the polishing pad, so as to buffer compressing stress generated towards the central region of the polishing pad due to swing motion of the wafer during the polishing process, but, at the same time, not to cause breakage of the wafer when the central region becomes too thin. Accordingly, the present invention provides stress buffer patterns designed in the central region of the polishing pad to buffer the stress in the central region created during the polishing process to prevent the surface of the central region from being protruded and thus prevent the surface of the central region, once protruded, from rubbing against the wafer carrier, so that contamination of the surface of the wafers due to particles generated from the rubbing can be avoided.

In yet another preferred embodiment, in order to prevent particles from being generated when the sidewall 220, which connects the polishing surface 202 and the back surface 204 of the polishing pad 200, rubs against the retaining ring of the wafer carrier during a polishing process, a cambered surface 222 is formed at the join of the sidewall 220 and the polishing surface 202. The cambered surface 222 can be formed via a mechanical process, such as by using a cutter to cut on the sidewall 220 near the polishing surface 202 to form the cambered surface 222, or via a chemical process, such as etching to form the cambered surface 222 on the sidewall 200 at the join of the sidewall 220 and the polishing surface 202. Of course, the cambered surface 222 can be also formed via a molding process.

Figure 3I:
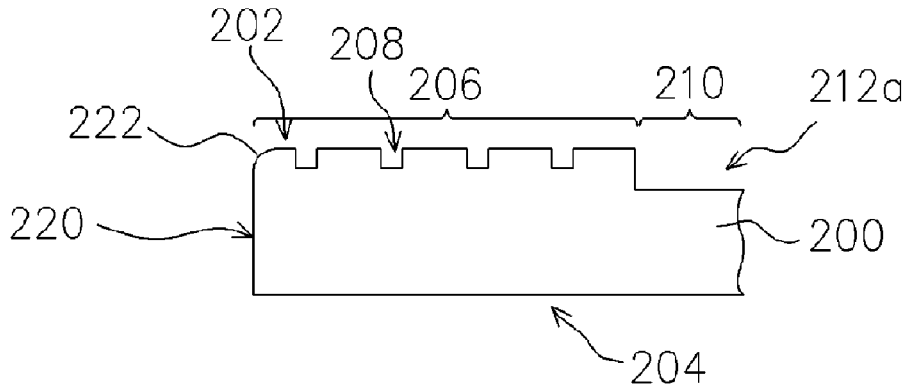
Figure 3J:
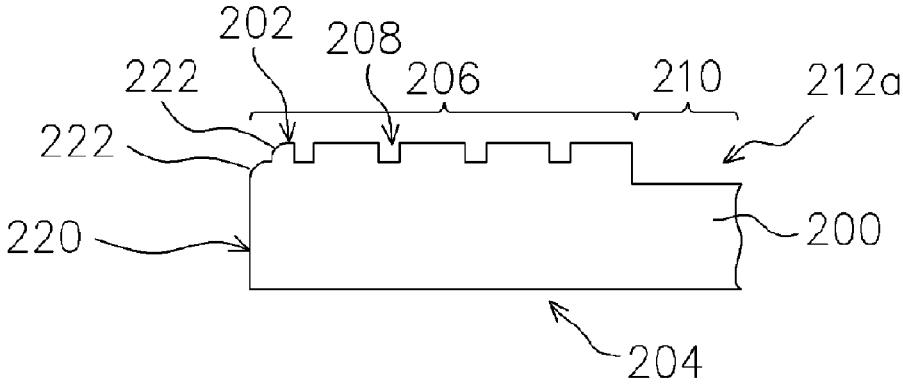

In accordance with yet another preferred embodiment, referring to FIG. 3J, a plurality of cambered surfaces 222 (two cambered surfaces are shown in FIG. 3J) can be formed at the join of the sidewall 220 and the polishing surface 202 in order to prevent particles from being generated when the sidewall 220, which connects the polishing surface 202 and the back surface 204 of the polishing pad 200, rubs against the retaining ring of the wafer carrier during a polishing process. The methods to form such cambered surfaces are the same as that described above, and thus are not further described here for simplicity.

Figure 3K:
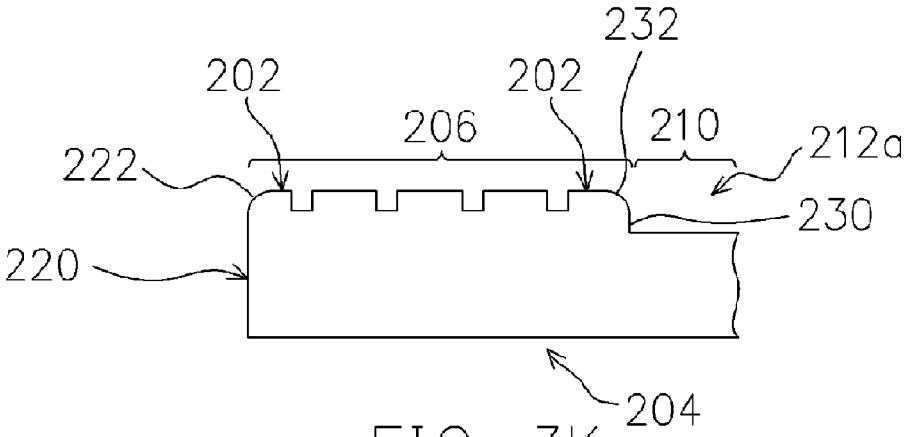

Referring to FIG. 3K, it is worthy of notice that after the stress buffer pattern 212*a* (i.e., the opening) is formed in the central region 210 of the polishing pad 200, the angle between the polishing surface 202 and the side surface 230 of the stress buffer pattern 212*a* is a straight right angle, and thus the edge portion of the right angle may similarly rub against the retaining ring of the wafer carrier to generate particles. Thus, at least one cambered surface 232 is formed on the side surface 230 of the stress buffer pattern 212*a* near the polishing surface 202. The methods for forming the cambered surface 232 are identical to that for forming the cambered surface 222, and thus are not further described for simplicity. As described above, a cambered surface is designed on the side surface 230 of the stress buffer pattern 212*a* of opening near the polishing surface 202. On the other hand, the cambered surface can also be designed on the side surface 230 of the stress buffer pattern 212*b* of trenches near the polishing surface 202. Moreover, the number of the cambered surfaces can be more than one.

As described in the foregoing embodiments, the cambered surface 222 are all shown in coexistence with the stress buffer pattern 212*a* or 212*b*. However, if the problem is focused on particles generated from the sidewall 220 of the polishing pad 200 during a polishing process, the cambered surface 222 could be designed without the presence of any stress buffer pattern. In other words, the stress buffer pattern or the cambered surface can be selectively designed on the polishing pad, or the stress buffer pattern and the cambered surface can be jointly designed on the polishing pad, so as to prevent the protruded central region of the polishing surface or the sidewall from rubbing against the wafer carrier, and prevent the wafers from being contaminated during the polishing process.

Figure 4:
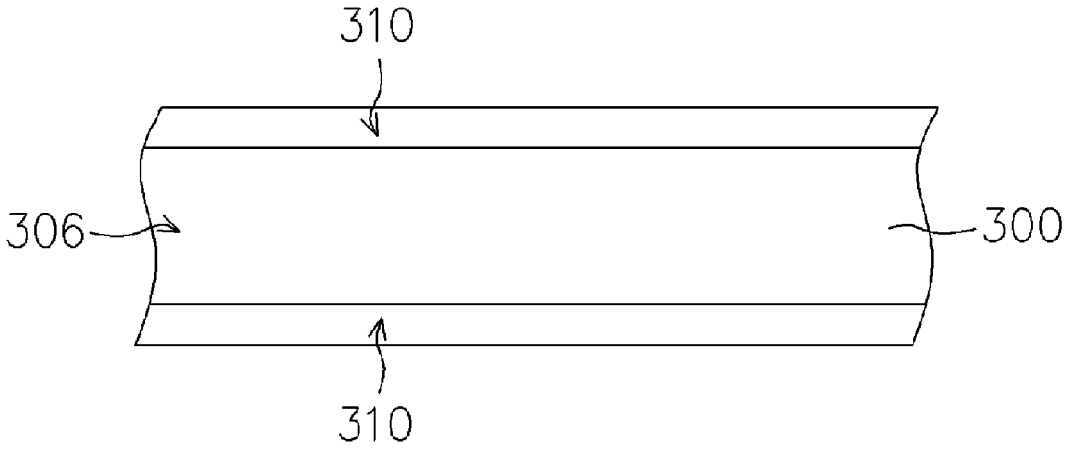
FIG. 4 is a top view showing a polishing pad according to another preferred embodiment of the present invention.

The above embodiments are described for a circular polishing pad. The present invention may also be applied to other polishing pads such as a linear polishing pad. As shown in FIG. 4, the polishing pad 300 is a linear polishing pad having a polishing region 306 and an edge region 310 neighboring to the polishing region 306, wherein the edge region 310 is beside the polishing region 306. In particular, at least one stress buffer pattern is formed in the edge region 310. The stress buffer pattern may be formed in the edge region 310 of the polishing surface, the back surface or both the polishing surface and the back surface as the above mentioned. In another embodiment, a cambered surface is further formed on the sidewall of the polishing pad 300 of FIG. 4, wherein the cambered surface is adjacent to the polishing surface as shown in FIGS. 3I and 3J. In another embodiment, a cambered surface is further formed on a side surface of the stress buffer pattern in the edge region 310 of the polishing pad 300 of FIG. 4, wherein the cambered surface is adjacent to the polishing surface as shown in FIG. 3K.

It will be apparent to those skilled in the art that various modifications and variations can be made to the structure of the present invention without departing from the scope or spirit of the invention. In view of the foregoing, it is intended that the present invention covers modifications and variations of this invention provided they fall within the scope of the following claims and their equivalents.

What is claimed is:

1. A polishing pad having a top surface, a back surface, and a sidewall connected to the top surface and the back surface, and the polishing pad is divided into a polishing region and a stress buffer region neighboring to the polishing region, and the stress buffer region is at the center or edge of the polishing pad, characterized in that:

at least one stress buffer pattern disposed in the stress buffer region neighboring to the polishing region, wherein the stress buffer pattern comprises a plurality of trenches or at least one opening having a first depth less than a thickness of the polishing pad; and a plurality of trenches with a second depth disposed on the top surface in the polishing region, wherein the first depth is greater than the second depth.

2. The polishing pad according to claim 1, wherein the stress buffer pattern in the stress buffer region is formed on the top surface.

3. The polishing pad according to claim 1, wherein the stress butter pattern in the stress buffer region is formed on the back surface.

4. The polishing pad according to claim 1, wherein the stress buffer pattern in the stress buffer region is formed on both the top surface and the back surface.

5. The polishing pad according to claim 1, wherein the first depth of the trenches or the opening is less than half of the thickness of the polishing pad.

6. The polishing pad according to claim 1, wherein a cambered surface is further formed on the sidewall, while the cambered surface is adjacent to the top surface.

7. The polishing pad according to claim 1, wherein a cambered surface is further formed on a side surface of the stress buffer pattern adjacent to the top surface.

8. The polishing pad according to claim 1, wherein the polishing pad is a circular polishing pad and the stress buffer region having the stress buffer pattern therein is at the center of the polishing pad.

9. The polishing pad according to claim 1, wherein the polishing pad is a linear polishing pad and the stress buffer region having the stress buffer pattern therein is at the edge of the polishing pad.

10. A method for fabricating a polishing pad having a top surface, a back surface, and a sidewall connected to the top surface and the back surface, and the polishing pad is divided into a polishing region and a stress buffer region neighboring to the polishing region, and the stress buffer region is at the center or edge of the polishing pad, the method comprising:

forming a stress buffer pattern in the stress buffer region neighboring to the polishing region, wherein the stress buffer pattern comprises a plurality of trenches or at least one opening having a first depth less than a thickness of the polishing pad; and forming a plurality of trenches with a second depth on the top surface in the polishing region, wherein the first depth is greater than the second depth.

11. The method according to claim 10, wherein the stress buffer pattern is formed via a mechanical process, a chemical process or a molding process.

12. The method according to claim 10, wherein the stress buffer pattern in the stress buffer region is formed on the top surface.

13. The method according to claim 10, wherein the stress buffer pattern in the stress buffer region is formed on the back surface.

14. The method according to claim 10, wherein the stress buffer pattern in the stress buffer region is formed on both the top surface and the back surface.

15. The method according to claim 10, further comprising formation of at least one cambered surface on the sidewall adjacent to the top surface so as to prevent particles from being generated due to abrasion of the sidewall during a polishing process.

16. The method according to claim 15, wherein the cambered surface is formed via a mechanical process, a chemical process or a molding process.

17. The method according to claim 10, further comprising formation of at least one cambered surface at the join of the top surface and a side surface of the stress buffer pattern.

18. The method according to claim 17, wherein the cambered surface is formed via a mechanical process, a chemical process or a molding process.

19. The method according to claim 10, wherein the stress buffer pattern is formed at the center of the polishing pad.

20. The method according to claim 10, wherein the stress buffer pattern is formed at the edge of the polishing pad beside the polishing region.

* * * * *